US009955724B2

(12) United States Patent
Lord

(10) Patent No.: US 9,955,724 B2
(45) Date of Patent: May 1, 2018

(54) ELECTRONIC VAPOR PROVISION DEVICE

(71) Applicant: Nicoventures Holdings Limited, London (GB)

(72) Inventor: Christopher Lord, London (GB)

(73) Assignee: NICOVENTURES HOLDINGS LIMITED, London (GB)

( * ) Notice: Subject to any disclaimer, the term of this patent is extended or adjusted under 35 U.S.C. 154(b) by 0 days. days.

(21) Appl. No.: 14/401,503

(22) PCT Filed: May 14, 2013

(86) PCT No.: PCT/EP2013/059949

§ 371 (c)(1),
(2) Date: Nov. 14, 2014

(87) PCT Pub. No.: WO2013/171217

PCT Pub. Date: Nov. 21, 2013

(65) Prior Publication Data

US 2015/0128966 A1 May 14, 2015

(30) Foreign Application Priority Data

May 14, 2012 (GB) ..... 1208351.5

(51) Int. Cl.
*A24F 47/00* (2006.01)

(52) U.S. Cl.
CPC ..... *A24F 47/002* (2013.01); *A24F 47/008* (2013.01)

(58) Field of Classification Search
USPC ..... 320/114–115
See application file for complete search history.

(56) References Cited

U.S. PATENT DOCUMENTS

| | | | | |
|---|---|---|---|---|
| 8,499,766 | B1 * | 8/2013 | Newton | 131/273 |
| 2009/0095292 | A1 * | 4/2009 | Hamano | A61M 15/0085 128/203.14 |
| 2009/0272379 | A1 | 11/2009 | Thorens | |
| 2009/0283103 | A1 * | 11/2009 | Nielsen | A24F 1/30 131/273 |

(Continued)

FOREIGN PATENT DOCUMENTS

| | | | |
|---|---|---|---|
| CN | 2602620 | Y | 2/2004 |
| DE | 102010032587 | A1 | 2/2011 |
| EP | 2468118 | A1 | 6/2012 |

OTHER PUBLICATIONS

International Search Report and Written Opinion, dated Sep. 25, 2013, for PCT/EP2013/059949, filed May 14, 2013.

(Continued)

*Primary Examiner* — Eric Yaary
(74) *Attorney, Agent, or Firm* — Patterson Thuente Pedersen, P.A.

(57) ABSTRACT

An electronic vapor provision device comprising a body (4) configured to be releasably connectable to a vaporizer (10). The body (4) comprises a power cell (20), a computer processor (18), a memory (22) and an audio signalling device (16). The memory (22) stores information on a first user notification event comprising connection of the vaporizer. Moreover, the computer processor (18) is configured to identify when the first user notification event occurs and to notify a user of the event by emitting a user (10) notification sound from the audio signalling device (16).

14 Claims, 4 Drawing Sheets

(56) References Cited

U.S. PATENT DOCUMENTS

| | | | | |
|---|---|---|---|---|
| 2010/0171461 | A1* | 7/2010 | Baarman | H02J 5/005 320/108 |
| 2010/0194335 | A1* | 8/2010 | Kirby et al. | 320/108 |
| 2010/0313901 | A1* | 12/2010 | Fernando et al. | 131/330 |
| 2011/0265806 | A1 | 11/2011 | Alarcon et al. | |
| 2012/0325228 | A1* | 12/2012 | Williams | 131/328 |
| 2013/0037041 | A1* | 2/2013 | Worm et al. | 131/329 |
| 2013/0220315 | A1* | 8/2013 | Conley et al. | 128/202.21 |
| 2013/0228191 | A1* | 9/2013 | Newton | A61M 15/06 131/329 |
| 2013/0253427 | A1* | 9/2013 | Cerman | A61M 5/24 604/111 |
| 2015/0114408 | A1 | 4/2015 | Lord | |
| 2015/0128965 | A1 | 5/2015 | Lord | |
| 2015/0136153 | A1 | 5/2015 | Lord | |
| 2015/0257448 | A1 | 9/2015 | Lord | |

OTHER PUBLICATIONS

Written Opinion, dated May 27, 2014, for PCT/EP2013/059949, filed May 14, 2013.

International Preliminary Report on Patentability, dated Sep. 5, 2014, for PCT/EP2013/059949, filed May 14, 2013.

* cited by examiner

ELECTRONIC VAPOR PROVISION DEVICE

CLAIM FOR PRIORITY

This application is the National Stage of International Application No. PCT/EP2013/059949, filed May 14, 2013, which in turn claims priority to and benefit of British Patent Application No. GB1208351.5, filed May 14, 2012. The entire contents of the aforementioned applications are herein expressly incorporated by reference.

FIELD

The specification relates to electronic vapour provision devices. More particularly, but not exclusively, the specification concerns electronic vapour provision devices such as electronic cigarettes.

BACKGROUND

Electronic vapour provision devices are typically cigarette-sized and function by allowing a user to inhale a nicotine vapour from a liquid store by applying a suction force to a mouthpiece. Some electronic vapour provision devices have a light at the end which glows when the cigarette is in use to replicate the glowing tip of a cigarette. Electronic vapour provision devices include electronic cigarettes.

SUMMARY

In an embodiment there is provided an electronic vapour provision device comprising body configured to be releasably connectable to a vaporiser, wherein the body comprises a power cell, a computer processor, a memory and an audio signalling device; wherein the memory stores information on a first user notification event comprising connection of the vaporiser; the computer processor is configured to identify when the first user notification event occurs and to notify a user of the event by emitting a user notification sound from the audio signalling device.

The electronic vapour provision device may comprise a sensor configured to detect and signal to the processor when the vaporiser is connected to the body.

The memory may store information on one or more further user notification events and the processor may be configured to identify when each of the one or more events occurs and to notify the user of the event by emitting a user notification sound from the audio signalling device.

A stored user notification event may comprise the power cell charge falling below a lower threshold charge. Advantageously, the user is aware the device is low on power so can take actions such as recharging the device before leaving the home.

A stored user notification event may comprise the power cell charge rising above an upper threshold charge. Advantageously, the user is aware the device is charged and can start using the device again.

A stored user notification event can comprise the power cell being connected to a charging source. Advantageously, the user is aware the device has been connected correctly to a charging source and is charging.

A stored user notification event may comprise the power cell being disconnected from a charging source. Advantageously, the user is aware the device has been disconnected correctly form a charging source and is no longer charging.

A stored user notification event may comprise a fault in the electronic vapour provision device. Advantageously, the user is aware of a fault and can stop using the device and ascertain the type of fault.

Each user notification event may have a corresponding user notification sound.

By using different notification sounds, a user is able to distinguish between different notification events. A sound alert has the advantage that it can be short and memorable and different sounds are readily distinguishable. Short sounds are catchy and can stay in the mind so information can be imparted quickly and stay with the user to enable them to make use of the information.

Each user notification sound comprises a sequence of one or more beeps.

Moreover, different notification sounds may be distinguished from one another by one or more of the following characteristics: the number of beeps in a sequence, the frequency of each beep in a sequence, the duration of each beep in a sequence and the duration between beeps in a sequence.

Simple sounds are quicker to transmit and easier for a user to distinguish between and recall. A user can readily differentiate between sounds having different numbers of beeps, different frequencies and tones of beeps, distinct beep durations and distinct time gaps between beeps. Any given sound will be readily retained in the user's mind allowing them to decode the beep.

Each user notification sound can be configured to provide information to a user and allow a user to determine information about the corresponding user notification event. Moreover, the electronic vapour provision device may further comprise decode instructions. Furthermore, the decode instructions can comprise information on the meaning of a given notification sound.

When a user is notified of an event they are able to hear the notification sound and later recall this sound to decode the meaning of the sound.

The number of beeps of a notification sound may be substantially related to the severity of the user notification event such that more severe events have more beeps and less severe events have fewer beeps.

In another embodiment there is provided a device of the previous embodiment including the vaporiser connected thereto.

In another embodiment there is provided a method of an electronic vapour provision device of notifying a user of the device of an occurrence of a first user notification event, wherein the electronic vapour provision device comprises a body configured to be releasably connectable to a vaporiser; the body comprises a power cell, a computer processor, a memory and an audio signalling device; and the first user notification event comprises connection of the vaporiser; the method comprising initially storing in the memory information on a first user notification event; in response to the processor identifying when the first user notification event occurs, emitting a user notification sound from the audio signalling device.

In another embodiment there is provided an electronic smoking device comprising a power cell, a computer processor and an audio signaling device; wherein the computer processor is configured in use to identify when a predetermined user notification event occurs and notify a user of the event by playing a predetermined user notification sound on the audio signaling device, where the identified user notification event is selected from a stored notification event.

As used herein, the term vapour includes an aerosol and other fluid streams for provision to a user by the electronic vapour provision device.

BRIEF DESCRIPTION OF THE DRAWINGS

For a better understanding of the disclosure, and to show how example embodiments may be carried into effect, reference will now be made to the accompanying drawings in which.

DETAILED DESCRIPTION

Figure 1:
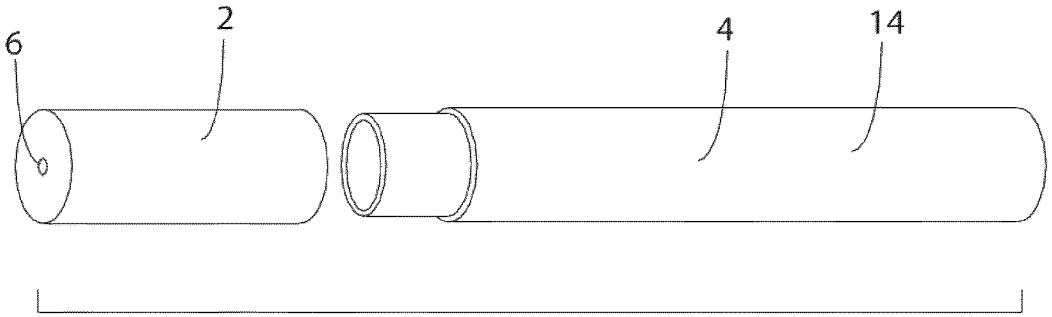
FIG. 1 is an exploded side perspective view of an electronic vapour provision device comprising a mouthpiece and body.
Figure 2:
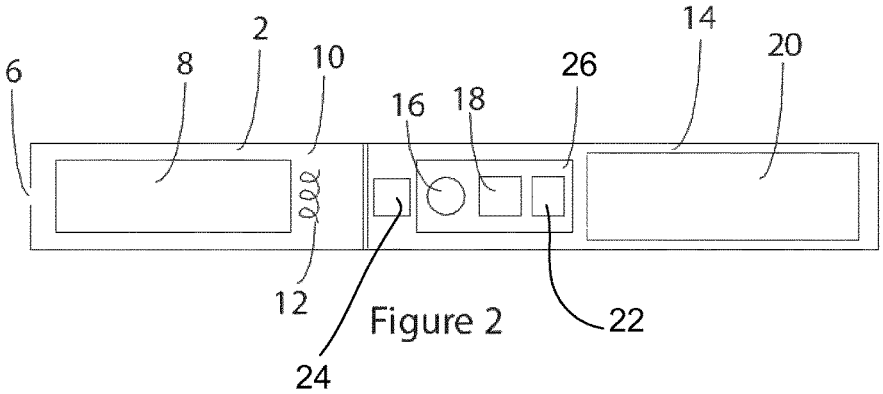
FIG. 2 is a side sectional view through the device of FIG. 1 wherein the mouthpiece and body are releasably connected.

FIG. 1 and FIG. 2 show an electronic vapour provision device in the form of a cigarette-shaped electronic cigarette. The electronic vapour provision device, also described herein as an electronic smoking device, comprises a mouthpiece 2 and a body 4.

The mouthpiece 2 can be removed and reattached to the body. In other words, the mouthpiece 2 and the body 4 are releasably connectable to one and other. The body 4 and the mouthpiece 2 are both cylindrical in shape, and are configured such that they connect coaxially, so as to form the conventional cigarette shape. The mouthpiece 2 comprises an air outlet 6 at a first end and is configured to coaxially connect to the body 4 at its second end.

The mouthpiece 2 contains a liquid store 8 and a vaporiser 10. The vaporiser comprises a heater coil 12. The vaporiser 10 is arranged next to the liquid store 8 to allow liquid to be transferred onto the vaporiser 10 for vaporising. For example, the vaporiser 10 may further comprise a mesh wick in fluid communication with the liquid store and configured to thereby communicate the liquid to the vicinity of the heater coil for vaporisation.

The body 4 comprises a battery assembly 14. The battery assembly 14 comprises an audio signaling device 16, computer processor 18, power cell 20 and memory 22. The battery assembly 14 further comprises a sensor arrangement 24 configured to detect at least connection of the vaporiser 10 to the body 4, resulting from connection of the mouthpiece 2 to the body 4. An example of such a sensor arrangement 24 is later described with reference to FIGS. 5 and 6.

The audio signaling device 16 and computer processor 18 are contained on a circuit board 26. The power cell 20 provides power to the electrical components of the device. The power cell 20 is therefore configured to provide power to the circuit board 26, and therein the audio signalling device 16, processor 18 and the memory 22. Moreover, the device is configured such that connection of the mouthpiece 2 and the body 4 establishes an electrical connection between the vaporiser 10 and the battery assembly 14 such that the vaporiser 10 can be powered by the power cell 20. For example, the configuration of the mouthpiece 2 and body 4 to be releasably connectable may comprise mutual screw thread connectors of the mouthpiece 2 and the body 4. Moreover, the mutual screw threads may provide an electrical contact between the mouthpiece 2 and the battery assembly 14.

The processor 18 is configured to interface with and control the power cell 20, memory 22 and audio signalling device 16. Moreover, the processor 18 may be configured such that, when the vaporiser 10 is connected to the battery assembly 14, it interfaces with and controls the vaporiser 10.

The herein described configuration of the processor 18 comprises the processor accessing and operating according to a computer program stored in the memory 22.

The electronic cigarette is configured such that, when the mouthpiece 2 is connected to the body 4, a user sucking on the mouthpiece 2 at the air outlet 6 causes a reduction in an air pressure inside the electronic cigarette. Moreover, the device is configured such that a reduced pressure inside the electronic cigarette causes the power cell 20 to provide power to the vaporiser 10 which in turn vaporises the nicotine liquid solution. The provided vapour then passes to the user. For instance, the air pressure changes resulting from a user sucking on the mouthpiece may comprise a pressure change at the battery assembly. Furthermore, the battery assembly 14 may comprise an air pressure sensor configured to detect changes in the air pressure at the battery assembly 14 and to provide information on pressure changes to the processor 18. The air pressure sensor is referenced 42 in FIGS. 6 and 7. Moreover, the processor 18 may be configured to respond to information from the air pressure sensor indicating that a user is sucking on the mouthpiece 2 by controlling the power cell 20 to provide power to the vaporiser 10. The electronic cigarette is configured such that the resultant vapour is provided through the air outlet 6.

The memory 22 contains user notification event data. The user notification events are events relating to states of the electronic device. The electronic cigarette is configured such that the processor 18 can determine when the electronic cigarette enters a particular state. The processor 18 is configured to then determine whether a determined state corresponds to one of the stored user notification events. Moreover, the processor 18 is configured to control the audio signalling device 16 to emit a sound if a determined state is found to correspond to one of the stored user notification events. The sound that is played is selected by the computer processor 18 and is a predetermined sound corresponding to the particular user notification event. For example, information defining the sound may be stored on the memory 22. Moreover, the stored data on each user notification event may comprise the information defining the sound corresponding to that event.

When a user hears the sound, the user is able to determine the meaning of the sound, for example by referring to instructions that explain the sounds and their meanings.

User notification occurs when the vaporiser 10 is connected to the battery assembly 14. The electronic cigarette being configured such that the processor 18 can determine when the electronic cigarette enters a particular state comprises the detection of the state of the vaporiser 10 being connected to the body 4. Moreover, user notification event data of the memory 22 comprises data on the user notification event of the vaporiser 10 being connected to the body 4.

When the vaporiser 10 is connected to the body 4, as a result of the mouthpiece 2 being connected to the body 4, this is detected by the sensor arrangement 24. The sensor arrangement 24 provides information to the processor 18 indicating that the vaporiser 10 is connected. The processor 18 determines from this provided information that the cigarette has entered the state of the vaporiser 10 being connected to the body 4. Furthermore, the processor 18 then determines that this state corresponds to the stored user notification event of vaporiser 10 connection. The processor 18 therefore selects a sound corresponding to the notification event and controls the audio signalling device to emit this sound. For example, the sound corresponding to this event may be a single beep. The user is able to hear the sound, interpret the event and understand that the vaporiser 10 is successfully connected.

Further user notifications will now be described.

When the charge in the power cell 20 falls below a lower reference charge, the computer processor 18 may detect this state. For example, the sensor arrangement 24 may comprise a device for determining the charge of the power cell 20 and may provide information to the processor accordingly. Moreover, the processor 18 may determine that this state corresponds to a stored user notification event and may notify the user by playing three beeps of equal tone on the audio signalling device 16. The user is able to hear the sound, interpret the event and take action to charge the device.

The device may be configured such that it can be connected to an external power (not shown) source for charging of the power cell 20. Moreover, the device may be configured such that the processor 18 can determine when the device is connected to the external power source. For example, the sensor arrangement 24 may be configured to detect when the device is connected to the external power source and to provide this information to the processor 18. Furthermore, connection to the external power source may be one of the user notification events. Consequently, if the user takes action by connecting the electronic cigarette to the power source for charging, the processor may determine that this state corresponds to a stored user notification event and may notify the user by playing for example two beeps of increasing pitch on the audio signalling device 16. The user is able to hear the sound, interpret the event and understand that the device is charging.

Moreover, when the electronic cigarette is being charged, as described above, and the charge in the power cell 20 reaches or exceeds an upper threshold reference charge, or the device is disconnected from a power source, the computer processor 18 detect this. For example, the sensor arrangement 24 may be configured to detect this and to provide information to the processor indicating this. The processor 18 may then determine that this is a stored user notification event and may notify the user by playing for example two beeps of decreasing pitch on the audio signalling device 16. The user is able to hear the sound, interpret the event and understand that the device is charged or has been separated from power.

The computer processor 18 may be configured to determine when there is a fault with the electronic cigarette. For example, the computer processor 18 may determine that the device is not operating correctly or the sensor arrangement 24 may for example be configured to detect mechanical or electrical faults in the device. The processor may then determine that a detected fault state corresponds to a stored user notification event and may notify the user by playing for example four beeps, each of decreasing pitch. The user is able to hear the sound, interpret the event and cease use of the faulty device.

Figure 3:
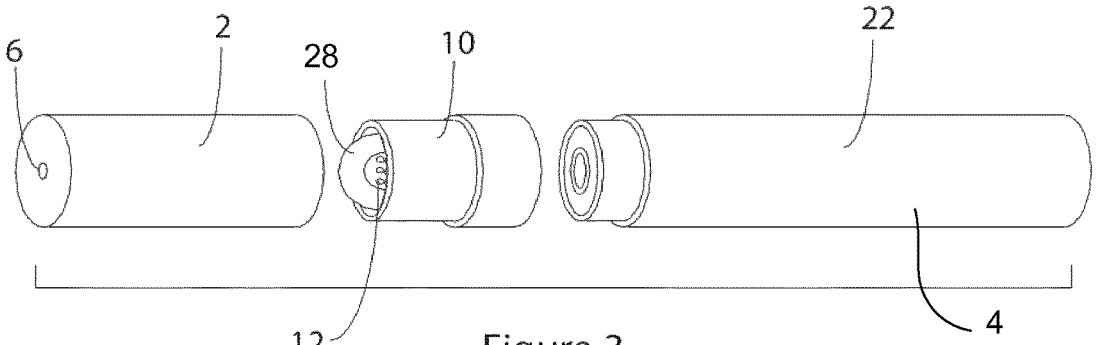
FIG. 3 is an exploded side perspective view of an electronic vapour provision device comprising a mouthpiece, vaporiser and battery assembly.
Figure 4:
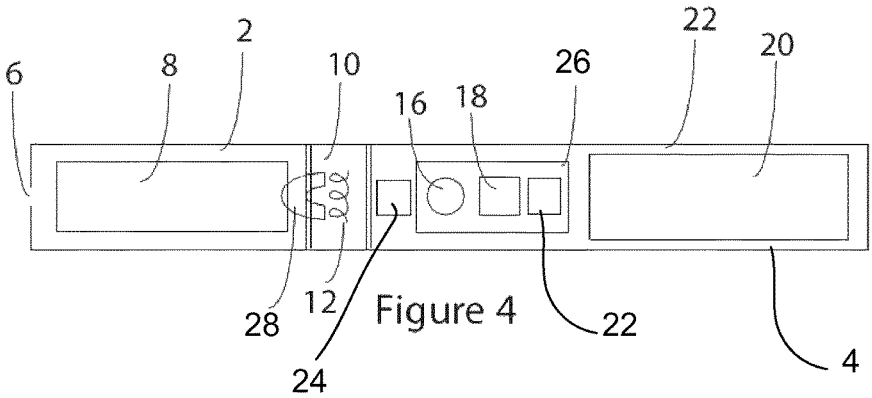
FIG. 4 is a side sectional view through the device of FIG. 3 wherein the mouthpiece, vaporiser and battery assembly are releasably connected.

FIG. 3 and FIG. 4 show an electronic vapour provision device similar to that described with reference to FIG. 1 and FIG. 2. However, the mouthpiece 2 no longer comprises the vaporiser 10. Instead, electronic cigarette has three separate and releasably connectable parts, the mouthpiece 2, vaporiser 10 and body 4. The vaporiser 10 is configured to separately connect to the mouthpiece 2 and the body 4, such that when connected it is located between the mouthpiece 2 and the body 4 and there provides a longitudinal section of the cylindrical outer surface of the cigarette shape. The mouthpiece 2 contains the liquid store 8 and attaches to the vaporiser 10. The vaporiser 10 has a wick 28 which comes into contact with the liquid in the liquid store 8 when connected to transfer the liquid onto the vaporiser 10.

Similar to the cigarette of FIGS. 1 and 2, the sensor arrangement 24 of the battery assembly is configured to sense when the vaporiser 10 is connected to the body and to provide information indicating this to the processor 18.

The configuration of the device to notify a user of user notification events, such as the connection of the vaporiser 10 to the body 4, is as described with reference to the cigarette of FIGS. 1 and 2.

Figure 5:
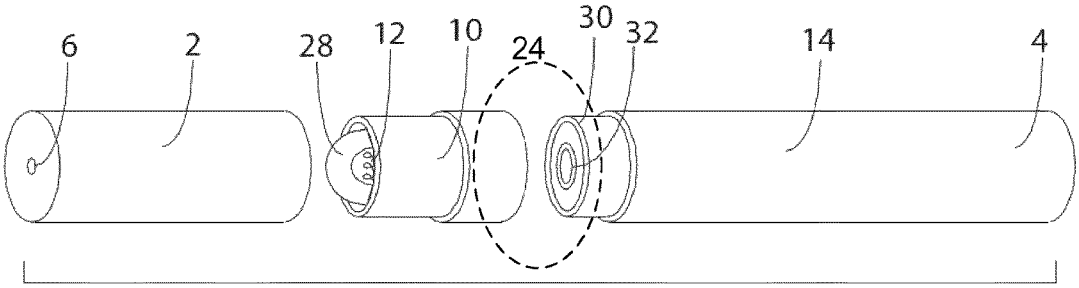
FIG. 5 is an exploded side perspective view of the device of FIG. 3 comprising an example sensor arrangement.
Figure 6:
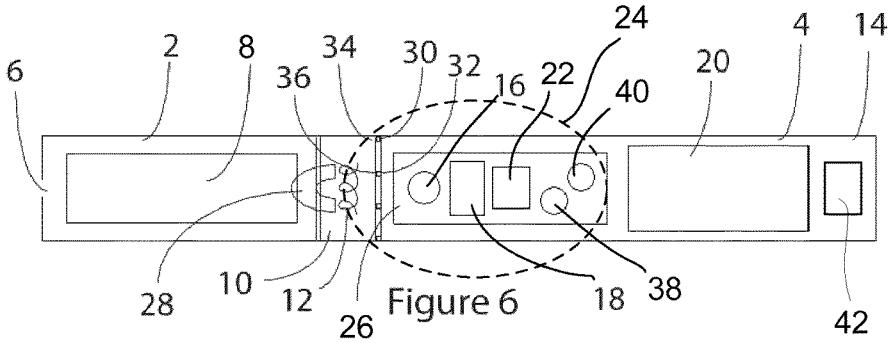
FIG. 6 is a side sectional view through the electronic vapour provision device of FIG. 5 wherein the mouthpiece, vaporiser and battery assembly are releasably connected.
Figure 7:
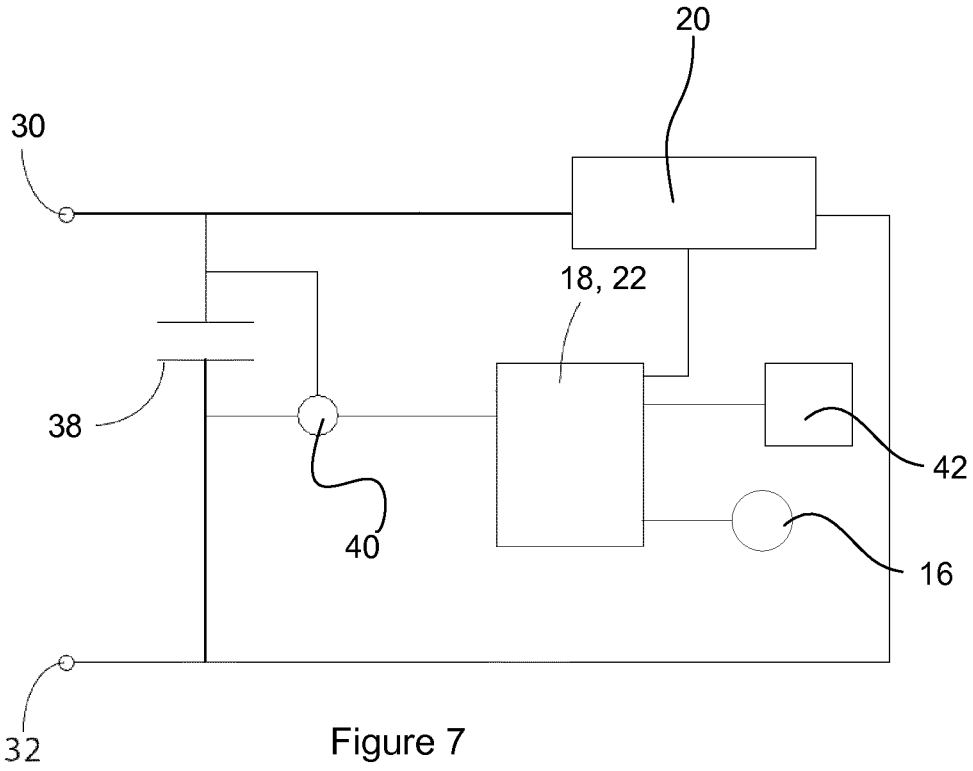
FIG. 7 is a circuit diagram of the battery assembly of FIG. 6.

FIGS. 5 to 7 show the electronic vapour provision device of FIGS. 3 and 4 wherein an example of an aspect of the sensor arrangement 24 is illustrated.

The sensor arrangement 24 comprises first and second battery assembly connection terminals 30 32 of the battery assembly 14, and first and second vaporiser connection terminals 34 36 of the vaporiser. The sensor arrangement 24 further comprises capacitor 38 of the battery assembly, connected in parallel with the first and second battery assembly connection terminals 30 32. Moreover, the sensor arrangement 24 comprises a digital multimeter 40 of the battery assembly 14, wired in a switched parallel circuit to the capacitor 38.

The vaporiser terminals 34 36 are electrically connected in parallel to the vaporiser 10. Moreover, the sensor arrangement 24 is configured such that when the vaporiser 10 is connected to the battery assembly 14, the first battery assembly connection terminal 30 is connected to the first vaporiser connection terminal 34 and the second battery assembly connection terminal 32 is connected to the second vaporiser connection terminal 36, and an electrically conductive contact is formed in both cases.

The processor 18 is configured to use the sensor arrangement 24 to determine whether the vaporiser 10 is connected to the battery assembly 14 as follows. The processor 18 first controls the power cell 10 to charge the capacitor 38, then waits a short time and checks the charge of the capacitor 38. In order to check the charge of the capacitor 38, the processor 18 triggers the completion of the switched digital multimeter circuit and then receives information from the multimeter 40 indicating a voltage across the capacitor 38 resulting from the charge of the capacitor 38. If the vaporiser 10 is connected, the resistance of the vaporiser 10 causes the capacitor 38 to discharge quickly so the processor 18 measures at least a substantially fully discharged capacitor 38. If the vaporiser 10 is not connected the capacitor 38 is not substantially fully discharged when checked by the processor 18.

With regard to the embodiments described herein, the following alternatives and variations will now be described.

The computer processor 18 could be a microprocessor or a microcontroller.

The device is not restricted to being cigarette shaped.

The sensor arrangement 24 may take other forms to that described. For example, the sensor arrangement 24 may comprise only one sensor, for instance a pressure sensor configured to detect a mechanical pressure resulting from connection of the vaporiser to the body.

The computer processor 18 and audio signalling device and not restricted to being on the same circuit board.

A user notification sound may be configured to be memorable by a user. Moreover, each user notification sound may be short for ease of recollection by a user.

If a notification comprises a sequence of beeps, the sequence may be configured to be clear and easy to remember by a user. For example, a notification sound may comprise two beeps of equal pitch. Furthermore, a notification sound may comprise two beeps where the second beep has a higher pitch than the first beep. Moreover, a notification sound may instead comprise two beeps where the second beep has a lower pitch that the first beep.

A notification sound may comprise a single beep.

The audio signalling device 16 may for example comprise a buzzer or a speaker.

The air pressure sensor may form part of the sensor arrangement.

Although examples have been shown and described it will be appreciated by those skilled in the art that various changes and modifications might be made without departing from the scope of the invention.

In order to address various issues and advance the art, the entirety of this disclosure shows by way of illustration various embodiments in which the claimed invention(s) may be practiced and provide for superior electronic vapour provision devices. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future. Any feature of any embodiment can be used independently of, or in combination with, any other feature.

The invention claimed is:

1. An electronic vapor provision device comprising:

a vaporizer;

a body configured to be releasably connectable to the vaporizer, the body including a power cell, a computer processor, a sensor comprising a pressure sensor, a memory and an audio output device, the memory configured to store information for:

a first user notification event comprising connection of the vaporizer, wherein the computer processor is configured to determine whether the vaporizer is connected to the body from a mechanical pressure detected by the sensor; and one or more further user notification events relating to states of the electronic vapor provision device, the information stored for each user notification event including information defining a user notification sound corresponding to that event; and wherein the computer processor is configured to:

determine when the electronic vapor provision device enters a state;

identify when the determined state corresponds to one of the first user notification event or the one or more further user notification events;

select the user notification sound corresponding to the particular one of the first stored user notification event or the one or more further stored user notification events; and control the audio output device to emit the selected user notification sound to notify the user of the event.

2. The electronic vapor provision device of claim 1, wherein the one or more further user notification events comprises a charge of the power cell falling below a threshold charge.

3. The electronic vapor provision device of claim 1, wherein the one or more further user notification events comprises the power cell being connected to a charging source.

4. The electronic vapor provision device of claim 1, wherein the one or more further user notification events comprises the power cell being disconnected from a charging source.

5. The electronic vapor provision device of claim 1, wherein the one or more further user notification events comprises a fault in the electronic vapor provision device.

6. The electronic vapor provision device of claim 1, wherein each user notification sound comprises one or more beeps, and notification sounds are distinguished from one another by one or more of the following characteristics:

the number of beeps in a sequence;

a frequency of each beep in a sequence;

a duration of each beep in a sequence; and a duration between beeps in a sequence.

7. The electronic vapor provision device of claim 1, further comprising decode instructions.

8. The electronic vapor provision device of claim 7, wherein the decode instructions comprise information on a meaning of a given user notification sound.

9. The electronic vapor provision device of claim 1, wherein the audio output device comprises a buzzer.

10. The electronic vapor provision device of claim 1, wherein each user notification sound comprises a plurality of beeps, and a number of beeps in the plurality of beeps is larger when the corresponding user notification event is a fault event than when the corresponding user notification event is not a fault event.

11. The electronic vapor provision device of claim 1, wherein the vaporizer is connected to the body.

12. A method of operating an electronic vapor provision device having a body configured to be releasably connectable to a vaporizer, the body having a power cell, a computer processor, a sensor comprising a pressure sensor, a memory and an audio output device, the method comprising:

storing, in a memory, information on:

a first user notification event associated with connection of the vaporizer, wherein the computer processor is configured to determine whether the vaporizer is connected to the body by a mechanical pressure detected by the sensor; and one or more further user notification events, wherein the one or more further user notification events are events relating to states of the electronic vapor provision device, wherein at least one of the user notification events relates to a fault event, and at least one of the user notification events relates to a non fault event;

wherein the information stored on each user notification event comprises information defining a user notification sound associated with that user notification event; and determining, via a computer processor, a state of the electronic vapor provision device;

identifying when the determined state corresponds to a particular one of the first stored user notification event or the one or more further stored user notification events;

selecting the user notification sound corresponding to the particular one of the first stored user notification event or the one or more further stored user notification events; and controlling the audio output device to emit the selected user notification sound, thereby notifying the user of the user notification event associated with the selected user notification sound.

13. The electronic vapor provision device of claim 1, wherein at least one of the user notification sounds comprises a first beep having a first pitch and a second beep having a second pitch that is different from the first pitch.

14. The electronic vapor provision device of claim 1, wherein one of the one or more further user notification events comprises a charge of the power cell reaching or exceeding an upper threshold reference charge.

* * * * *